United States Patent [19]

Miko

[11] Patent Number: 4,662,141

[45] Date of Patent: May 5, 1987

[54] ROOFING ELEMENT

[75] Inventor: Hans-Jürgen Miko, Vöcklabruck, Austria

[73] Assignee: Eternit-Werke Ludwig Hatschek Aktiengesellschaft, Austria

[21] Appl. No.: 828,007

[22] Filed: Feb. 10, 1986

[30] Foreign Application Priority Data

Feb. 13, 1985 [AT] Austria ..... 415/85

[51] Int. Cl.[4] ..... E04D 1/00

[52] U.S. Cl. ..... 52/553; 52/478; 52/518; 52/533

[58] Field of Search ..... 52/553, 478, 533, 198, 52/518

[56] References Cited

U.S. PATENT DOCUMENTS

| | | | |
|---|---|---|---|
| 1,931,709 | 10/1933 | Schaffert | 52/553 X |
| 2,210,941 | 8/1940 | Leemhuis | 52/553 |
| 3,862,532 | 1/1975 | Markos | 52/553 X |
| 4,432,183 | 2/1984 | Pike et al. | 52/478 X |

FOREIGN PATENT DOCUMENTS

| | | | |
|---|---|---|---|
| 518445 | 2/1931 | Fed. Rep. of Germany | 52/553 |
| 60705 | 8/1912 | Switzerland | 52/553 |

*Primary Examiner*—J. Karl Bell

*Attorney, Agent, or Firm*—Townsend and Townsend

[57] ABSTRACT

The invention relates to a roofing element, in particular a concrete roofing panel, at whose underside extend a suspension ledge and a base rib, while at least two cross ribs of lesser thickness than the base rib extend in the covering or overlapping region next to the base rib and parallel thereto, with the basic surface of the base rib extending parallel in relation to the outer surface of the roofing element. For increasing the tightness of the roofing element, the thickness of the roofing element of optionally S-shaped or wave-shaped cross section in the apex of the cross rib farthest removed from the base rib is slightly, up to 6 percent at the most, less than the thickness of the roofing element in the base rib and the height of further cross ribs disposed between the base rib and the cross rib farthest removed from the base rib is less than the height of the cross rib farthest removed from the base rib.

9 Claims, 1 Drawing Figure

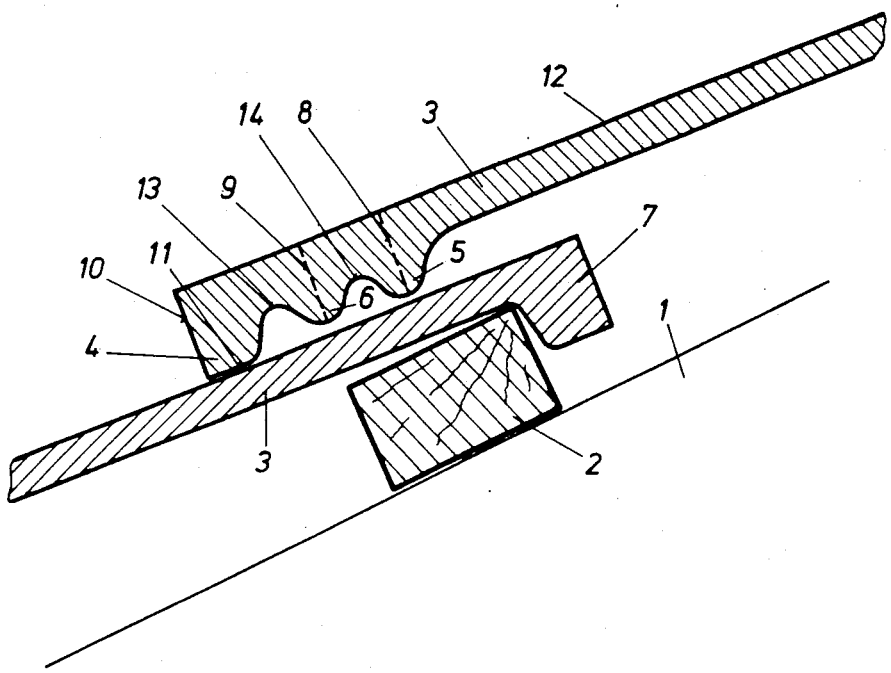
12
14
8
3
13
9
7
10
11
5
6
1
4
3
2

ROOFING ELEMENT

The invention relates to a roofing element, in particular a concrete roofing panel, at whose underside extend a suspension ledge and a base rib, while at least two cross ribs of lesser thickness than the base rib extend in the covering or overlapping region next to the base rib and parallel thereto, while the basic surface of the base rib extends parallel in relation to the outer surface of the roofing element.

Roofing elements of this type are known, for instance, from AT-PS No. 278321. The sealing behavior and the support of such roofing elements on a roofing element disposed underneath is not optimal, however, and moisture and wind can penetrate.

It is the object of the invention to form roofing elements of this type in such a manner that they assure the tightest possible sealing against penetrating moisture and drafts in the finished roof.

According to the invention, this is achieved in a roofing element of the type initially mentioned by providing, so as to increase the tightness of the roofing element, for the thickness of the roofing element of optionally S- or wave-shaped cross section, to be slightly less, up to 6 percent at the most, in the apex of the cross rib farthest removed from the base rib than the thickness of the roofing element in the base rib, and by providing for further cross ribs disposed between the base rib and the cross rib farthest removed from the base rib to be of lesser height than the cross rib farthest removed from the base rib. The cross rib farthest removed from the base rib, which is only slightly shorter than the base rib, prevents any riding up, but at the same time creates a space between itself and the base rib which is available as a swirl chamber for penetrating air streams, so that penetrating air streams are calmed down and penetrating moisture can run off without being influenced by capillarity due to the inclination of the roof on the respective lower or overlapped roofing element. The pressure of the penetrating air is reduced and a controlled pressure compensation between the swirl chamber and the interior of the roof or the space below the roofing is possible. The forming of the further cross rib(s) with lesser height than the cross rib farthest removed from the base rib improves the effect of the swirl chamber and thus the sealing effect between the roofing elements in the overlapping region. Preferred is a thickness of the roofing element in the apex of the further cross ribs disposed between the base rib and the cross rib farthest removed from it of about 8 to 16 percent, preferably about 10 to 12 percent, less than the thickness of the roofing element at the base rib.

The flowing conditions are further improved in respect of sealing and minimization of drafts penetrating into the interior of the roof if the thickness of the roofing element above the bottom of the grooves between the base rib and the further cross ribs and between these and the cross rib farthest removed from the base rib is equal.

The overall result is a roofing element of optimal sealing effect which is simple to produce and stable.

The invention is explained by means of an exemplary embodiment under reference to the accompanying drawing.

The drawing shows two roofing elements 3 in the overlapping region in section. In the present case, the roofing elements are of S-shape or wave-shape in cross section (vertical to the drawing plane). On a roof 1, there is a lattice 2 onto which the roofing elements 3 are hooked by means of a suspension ledge 7, so that roofing elements 3 which are hooked onto a lattice positioned higher rest on roofing elements 3 of a row underneath with their overlapping or base region. The base region of a roofing element 3 according to the invention is provided with a base rib 4 having a basic surface 11 extending in sections parallel to the longitudinal extension or the undulation parallel to the outer surface 12 of the roofing element. Adjacent to the base rib 4, with interposed grooves 13 and 14, is a further cross rib 6 and a cross rib 5 farthest removed from the base rib 4. It is provided for the thickness 8 of the roofing element 3 measured in the apex of the cross rib 5 farthest removed from the base rib to be slightly, up to 6 percent at the most, preferably 2 to 4 percent, less than the height of the front face 10 or the thickness of the base rib 4.

The thickness 9 of the further cross rib 6 disposed between the base rib 4 and the cross rib 5 farthest removed from the base rib 4 is about 8 to 16 percent, preferably about 10 to 12 percent, less than the height of the front face 10 or the thickness of the base rib 4.

The thickness of the roofing element in the bottoms of the grooves 13 and 14 is mutually equal.

The base rib 4 and the cross ribs 5 and 6 follow the undulation or the S-shaped form of the roofing element and are provided with the features according to the invention over their entire extensions.

On principle, it is possible to provide one or more further cross ribs outside of the cross rib 5 farthest removed from the base rib 4 in the overlapping region or to provide more than one further cross rib 6 between the base rib 4 and the cross rib 5 farthest removed from the base rib 4.

The roofing panels can have cross sections of S-shape or wave form, they can have straight or curved sections or be provided exclusively with straight sections or be of linear shape.

All the features described in the claims, the specification and in the drawing may be combined in any given manner.

I claim:

1. A roofing element at whose underside extend a suspension ledge and a base rib, while at least two cross ribs of lesser thickness than the base rib extend downwards in the covering or overlapping region next to the base rib and parallel thereto, in which covering region the roofing element in the installed state overlaps an underlying identical roofing element with the basic surface of the base rib extending parallel in relation to the outer surface of the roofing element, comprising that for increasing the tightness of the roofing element, the thickness of the roofing element in the crest (apex) of the cross rib farthest removed from the base rib is slightly, up to 6 percent at the most, less than the thickness of the roofing element in the base rib and that the height of further cross ribs disposed between the base rib and the cross rib farthest removed from the base rib is less than the height of the cross rib farthest removed from the base rib.

2. The roofing element according to claim 1, wherein the thickness of the roofing element in the crest (apex) of the further cross ribs disposed between the base rib and the cross rib farthest removed from the base rib is about 8 to 16 percent less than the thickness of the roofing element at the base rib.

3. The roofing element according to claim 1, wherein the thickness of the roofing element above the groove bottom of the grooves between the base rib and the further cross ribs and between these and the cross rib farthest removed from the base rib is equal.

4. The roofing element according to claim 1, wherein the roofing element is made of concrete.

5. The roofing element according to claim 1, wherein the roofing element is of S-shaped or wave-shaped cross section.

6. The roofing element according to claim 1, wherein the thickness of the roofing element in the crest (apex) of the further cross ribs disposed between the base rib and the cross rib farthest removed from the base rib is 10 to 12 percent less than the thickness of the roofing element at the base rib.

7. In a roofing element having a suspension ledge and an overlapping section opposite the suspension ledge for overlapping an adjacent roofing element, the improvement comprising:

a base rib extending a prescribed length from the overlapping section toward the adjacent roofing element for contacting the adjacent roofing element;

a first cross rib disposed between the base rib and the suspension ledge and extending a prescribed length from the overlapping section toward the adjacent roofing element; and a second cross rib disposed between the first cross rib and the suspension ledge and extending a prescribed length from the overlapping section toward the adjacent roofing element, the length of the second cross rib being greater than the length of the first cross rib, and the length of the second cross rib being less than the length of the base rib by up to approximately 6 percent of the length of the base rib.

8. The improvement according to claim 7 wherein the length of the first rib is less than the length of the base rib by a range from approximately 8 percent to approximately 16 percent of the length of the base rib.

9. In a roofing element having a suspension ledge and an overlapping section opposite the suspension ledge for overlapping an adjacent roofing element, the improvement comprising:

a base rib extending a prescribed length from the overlapping section toward the adjacent roofing element for contacting the adjacent roofing element;

a first cross rib disposed between the base rib and the suspension ledge and extending a prescribed length from the overlapping section toward the adjacent roofing element, the length of the first cross rib being less than the length of the base rib by a range from approximately 8 percent to approximately 16 percent of the length of the base rib; and a second cross rib disposed between the first cross rib and the suspension ledge and extending a prescribed length from the overlapping section toward the adjacent roofing element, the length of the second cross rib being less than the length of the base rib by up to approximately 6 percent of the length of the base rib.

* * * * *